United States Patent [19]

Wilson

[11] 4,140,204

[45] Feb. 20, 1979

[54] TWO-TUBE MUFFLER AND METHOD OF MANUFACTURE

[75] Inventor: Stanley P. Wilson, Harrison, Ark.

[73] Assignee: Gator Products, Inc., Harrison, Ark.

[21] Appl. No.: 820,445

[22] Filed: Aug. 1, 1977

[51] Int. Cl.[2] ..... F01N 1/06

[52] U.S. Cl. ..... 181/265; 181/269; 181/275; 181/296; 228/155; 228/173 R

[58] Field of Search ..... 181/255, 238, 239, 251, 181/264–265, 269, 275, 296; 228/155, 173

[56] References Cited

U.S. PATENT DOCUMENTS

| | | | |
|---|---|---|---|
| 2,675,088 | 4/1954 | McLeod | 181/269 X |
| 3,003,578 | 10/1961 | Ewashuk | 181/265 |
| 3,043,393 | 7/1962 | Hopkins | 181/255 |
| 3,191,715 | 6/1965 | Jettingoff | 181/269 |

*Primary Examiner*—Donald G. Kelly
*Attorney, Agent, or Firm*—Robert R. Keegan

[57] ABSTRACT

There is disclosed a muffler for an internal combustion engine, particularly an automobile engine, which includes a heavy steel outer casing formed from a section of cylindrical tubing together with an internal baffle structure of two sections of smaller diameter cylindrical steel tubing at least one of which is perforated to create a plurality of louvered openings extending along and around the tubing section. Each of the tubing sections has an end that is offset by reason of a pair of opposite-direction bends in the tubing, and the offset ends of the two sections of tubing are overlapped and joined together by welding or other suitable means to produce an extended baffle structure of approximately the same length as the outer casing. The offset ends of the sections of tubing which are joined together are preferably flattened on the sides adjacent to each other to reduce the maximum dimension of the baffle structure along the portion thereof where the two tube sections overlap. The muffler is preferably arranged with the louver openings in the perforated section in a direction counter to the flow of exhaust gases. The muffler is fabricated from readily available perforated and unperforated tubing by relatively simple metal forming equipment such as pipe bending machines and tube-doming die presses available to muffler and exhaust pipe replacement shops. Pipe bending machines are used to form the baffle structure as above described, and it is enclosed within the outer casing by doming the ends of the casing tubing in a doming die press, after which the ends of the baffle structure are secured in the reduced size openings in the end of the casing by welding.

11 Claims, 4 Drawing Figures

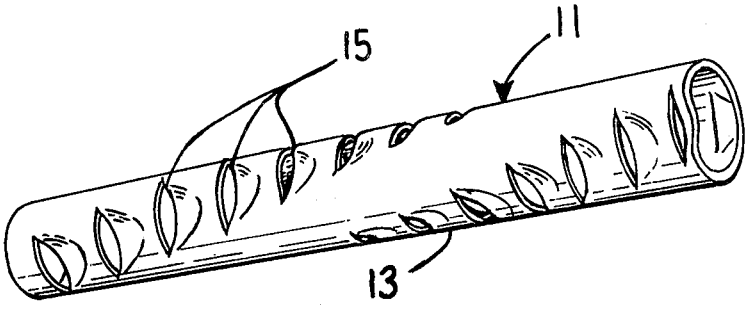
FIG. 1
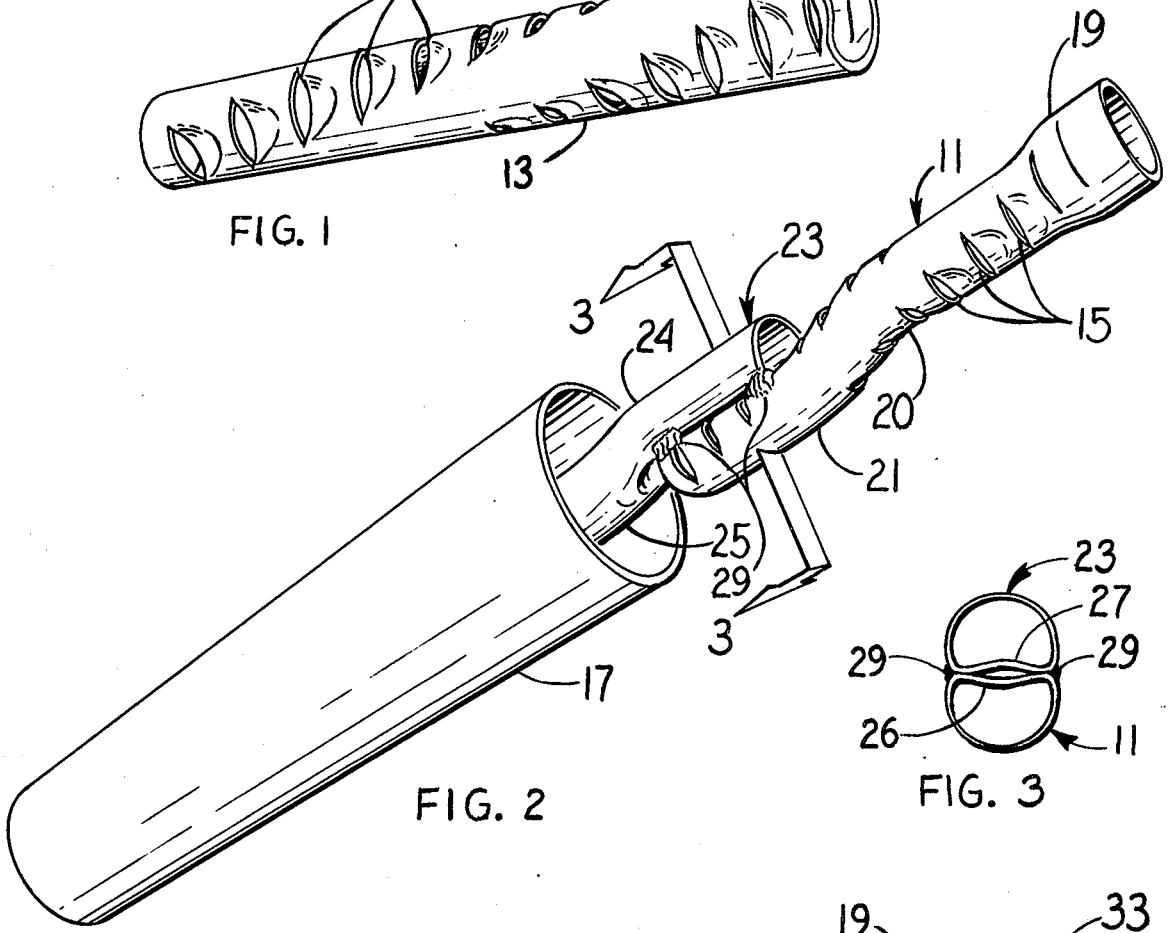
FIG. 2
FIG. 3
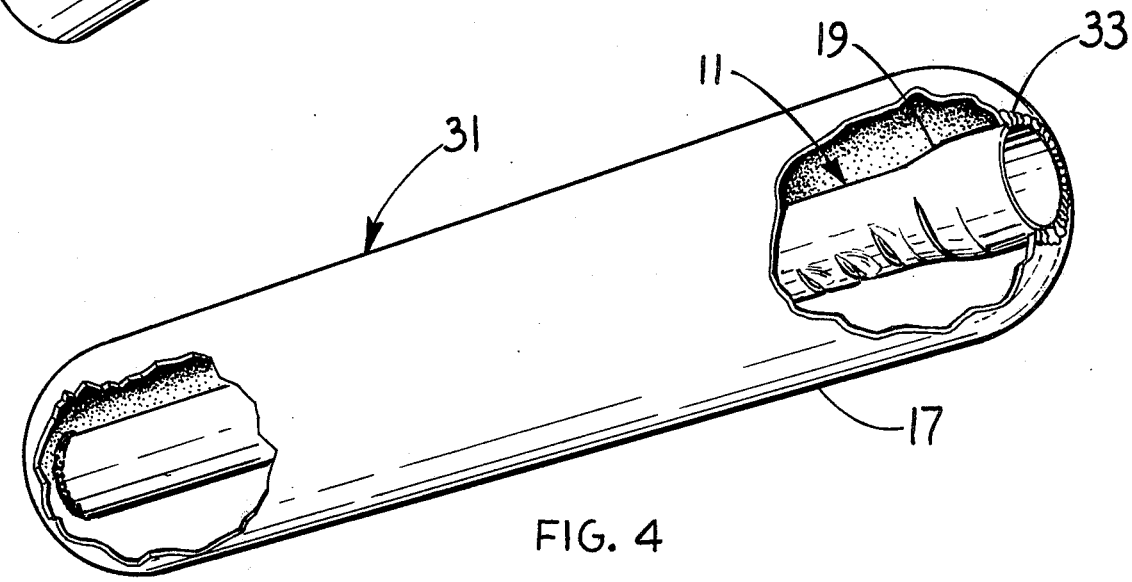
FIG. 4

TWO-TUBE MUFFLER AND METHOD OF MANUFACTURE

Applicant's co-pending design application for "Muffler-Making Attachment," Ser. No. 795,006, filed May 9, 1977, discloses an attachment structure for pipe bending machines which may be used to carry out the method of manufacturing mufflers according to the present invention.

The present invention relates to a muffler for automobiles or other internal combustion engine-powdered apparatus which is of remarkably simple and inexpensive construction, yet effective in sound suppression and having desirably low back pressure characteristics. The housing, or casing, of the muffler is in the form of an elongated cylinder and in the preferred simplest embodiment a circular cylinder. The casing preferably has domed ends, that is, ends of approximately hemispherical shape. This shape for the casing provides great mechanical strength in addition to which the casing is preferably made of heavy gauge tubing of carbon steel or stainless steel.

Exhaust gases enter through a central opening at one end of the muffler. The entrance opening communicates with a circular cylindrical tube of approximately the same or slightly greater diameter than the inlet pipe leading to the muffler. This tube, which will be referred to as the inlet tube, runs axially through the muffler for about half its length or slightly more. At this point the inlet tube opens into the muffler casing interior, and it will be noted that at this point the exhaust gases have encountered no constriction or obstruction of significant extent. There may be a slight reduction in cross-sectional area of this tube at the end due to its being deformed to a "D" shape, but this constriction is insignificant.

The inside diameter of the muffler casing may typically be at least 1½ times that of the inlet tube, and the cross-sectional area of the casing thus over twice that of the cross-sectional area of the inlet tube. Thus, the cross-sectional area of the interior of the casing even after subtracting the area of the inlet tube is great enough to permit axial counterflow of the exhaust gases without significant restriction.

Egress from the muffler for the exhaust gases is provided by a perforated cylindrical tube, which will be referred to as the outlet tube. It runs somewhat more than half the length of the muffler, generally along the axis and overlaps the inlet tube. One or both of the inlet and outlet tubes are offset for the length which they overlap the other. The perforations in the outlet tube are preferably formed in the shape of a louver with the louver inlet direction counter to the flow of gases through the outlet tube. Leaving the interior end of the outlet tube open gives most satisfactory performance, but the end may be closed or partially closed also. With the end of the outlet tube open, there is minimal restriction of the exhaust gases in the outlet tube, the gases being impeded only by the louvers and the action of the louvers in directing the gas flow.

It can be seen from the above description of the muffler that notwithstanding the generally unrestricted path for exhaust gases, any sound energy propagating through the muffler finds no direct path and through division and recombination of the sound energy, it has been found that the sound is highly effectively attenuated. Furthermore, attenuation of the sound is much more effective at higher engine rpm's where the necessity for attenuation of the higher level sound energy input is the greatest. As with previous forms of mufflers, the sound attenuation, particularly at low engine rpm, can be further reduced by the addition of a resonator in the exhaust system.

Mufflers are known which seek to minimize or eliminate restriction of the exhaust gas flow path, a notable example being so-called "glass-pack" mufflers, and other types of mufflers employ a very large housing volume with a complicated baffle structure to achieve sound energy attenuation. No muffler structure is known which achieves the 3 objectives of simplicity, satisfactory noise energy attenuation, and freedom from exhaust gas flow restrictions in the manner accomplished by the muffler structure according to the invention.

The method of manufacture of the muffler according to the present invention is also of great importance because it can be fabricated efficiently without the use of massive industrial-type metal forming machines. It is, therefore, perfectly feasible for a muffler replacement shop to manufacture mufflers according to the invention using only pipe bending machinery which they need for other purposes and simple attachments for doming the ends of the muffler casing. The operation is facilitated by the use of power metal saws which are also usually available in the muffler shop, and, of course, welding equipment is necessary. Mufflers can thus be installed of various sizes and incorporating various features and having inlet and outlet diameters of any desired sizes, all without the necessity of stocking a great number of different sizes and shapes of mufflers.

The process of manufacture can be summarized as follows. The casing is cut from relatively large diameter steel tubing on the order of 3½ to 4 inches in diameter. To form the baffle structure, 2 pieces of tubing of about 2inch diameter are cut, each approximately two-thirds the length of the finished muffler. Preferably one of these pieces of tubing is louvered tubing of a readily available type, used for making glass-pack mufflers. Alternatively, both of the tubing sections for the baffle structure may be of perforated tubing.

Each of the pieces of tubing for the baffle structure is offset for about a third of its length by approximately one-half of its diameter. If either of the tubing sections is to be flared to a diameter to accomodate connecting pipes, this also may be done at that time. Preferably, the offset sections of the tubing are flattened so that the offset ends of the respective tubes will overlap and fit snugly together. The tubes are then welded together by 2 or more spot welds to form a baffle structure with a length substantially equal to that of the muffler being constructed. The baffle structure thus formed is placed within the large tubing of which the casing is to be formed, and a doming die is used to deform the end of the tubing to a generally hemispherical shape with a central opening through which passes the inlet or outlet tubing of the baffle structure. Either at the same time or subsequently, the other end of the casing is also deformed by a doming die, thereby enclosing the baffle structure in the finished muffler casing configuration. The baffle structure is welded at each end to the muffler casing, and any excess length of tubing is removed, thereby completing the fabrication of the muffler.

It is an object of the present invention to provide a muffler for internal combustion engines which is of simple construction consisting essentially of only 3 parts, yet which provides quite effective sound suppression and creates minimal resistance to the flow of exhaust gases.

It is another object of the present invention to provide a muffler for internal combustion engines which consists of components cut from readily available steel tubing bent to simple shapes that can be achieved on standardized metal bending equipment and assembled by simple welding operations.

It is still another object of the present invention to provide a method of manufacturing mufflers for internal combustion engines which involves few steps and can be accomplished starting with readily available steel tubing and using simple metal cutting, bending and welding tools either already available or readily made available in muffler installation shops.

Other objects and advantages will be apparent from a consideration of the following description in conjunction with the appended drawings in which:

FIG. 1 is an isometric view of a section of perforated tubing utilized in construction of the muffler according to the present invention;

FIG. 2 is a perspective view of components of the muffler according to the present invention partially assembled;

FIG. 3 is a sectional view of the apparatus of FIG. 2 taken along the line 33 in FIG. 2; and FIG. 4 is a broken away perspective view of a muffler according to the present invention.

Referring now to FIG. 1, a section of perforated tube 11 is shown which is employed in the manufacture of mufflers according to the present invention. It will be observed that the tube 11 has a number of perforations 15 which are arranged in a spiral around the tube 11. Each of the perforations is formed as a louver, that is, there is little or no material removed to form the perforations 15 but rather there is a slot together with a depression or dimple so that the opening formed opens generally in an axial direction with respect to the tube 11, that is in FIG. 1 generally to the right. Tubing such as shown in FIG. 1 is a staple article of commerce used, for example, in the manufacture of glass-pack mufflers. Of course, other forms of perforated tubing may be used in the muffler construction of the present invention, or specially perforated tubing may be employed. For example, a greater number of smaller openings may be utilized than indicated in FIG. 1. In FIG. 1 the spacing of the perforations axially is about 1 inch while the diameter of the tubing is about 2 inches. The thickness of the tubing is subject to substantial variation but may typically be about 1/16th inch.

The muffler illustrated in FIGS. 1–4 will be described in terms of a preferred method of making the muffler, but it will be understood that a similar muffler could be produced by different methods and still have many features and advantages of the invention.

It is contemplated that mufflers made according to the preferred method will customarily be made substantially "to order." In other words, one muffler or a relatively small number of mufflers will be made to prescribed dimensions to fill a need of a customer or replenish stock of a commonly used item.

The tubing will customarily be received in relatively long lengths from 8 to 12 feet long so that parts for a substantial number of mufflers can be cut from a length without a proportionately large amount of waste.

As a first step, the tube 11 may be cut to a length approximately ⅔ the length of the muffler to be constructed. It is, of course, necessary to predetermine the muffler length that is desired, the diameter of the muffler casing, the diameter of the internal tubing and the inside diameters of the inlet and outlet to the muffler. The length of the tube section 11 relative to the length of the muffler can vary widely from little more than half the muffler length to nearly the full length of the muffler.

After tube section 11 has been cut to length, one end may be swaged to a larger diameter to accomodate the tailpipe if desired. If a larger diameter is not desired, it may still be desirable to use a swaging tool to bend the louvers closed to allow the tailpipe to enter the end of the outlet tube 11. In the preferred form shown in the drawings, the outlet end 19 of the tubing section 11 is determined so that the louvers 15 open into the tubing section 11 in a direction counter to the flow of the exhaust gases inside the tube 11.

The tube 11 is next offset by making two approximately equal and opposite bends 20 and 21 on a pipe bending machine of the sort used for bending tailpipes. Preferably, these bends are gentle bends of about 10° as shown in FIG. 2. They may be located approximately one-half way and three-quarters way from the outlet end 19 of the tube 11.

In order that the necessary offset of tube 11 be minimized, the inside of the offset portion may be deformed so that the interior end of tube 11 is D-shaped as shown in FIGS. 2 and 3. The deformation of the end of tubing 11 to D-shape may be accomplished on a pipe bending machine or in other suitable fashion.

The inlet tube 23 forming part of the baffle structure of the muffler is preferably formed of solid tubing rather than perforated tubing, as illustrated in the drawings. For special effects, however, the tube 23 may also be formed of perforated tubing. The shaping of tube 23 may proceed in the same fashion as previously described for tube 11. Of course, any swaging of tube 23 will be done at the inlet end of the muffler to accomodate the muffler inlet pipe from the exhaust manifold.

As shown in FIG. 2, tubes 11 and 23 are overlapped and joined together, by welding preferably. Four spot welds are shown holding the tubes together in FIG. 3, although 2 welds would be adequate. As shown in FIG. 3, the overlapped portions of the tubes 11 and 23 are of only slightly greater maximum dimension than a single tube due to their deformation to D-shaped cross-section and joining along the flat portions thereof.

When the baffle structure comprising tubes 11 and 23 is fabricated, it is then placed inside a casing 17 as illustrated in FIG. 2. The ends of casing 17 are then cold formed into hemispherical shape by forcing the ends of casing 17 into a doming die under hydraulic pressure. Preferably, the forming machine is arranged so that both ends of the casing 17 are formed simultaneously, that is, two generally similar doming dies deform both ends at the same time. The center of the doming die preferably has a mandrel to hold the ends of tubing 11 and 23 in position whereby the hemispherical ends of casing 17 are formed to fit snugly around tubes 11 and 23. The casing 17 will normally be cut to a length slightly greater than the intended length of the finished muffler. The extra length of casing 17 will depend upon the diameter of the casing but will normally be on the order of 1 inch. In general, the finished length of the muffler is not a critical dimension.

Once the ends of casing 17 have been closed, the baffle structure consisting of tubes 11 and 23 is firmly secured in the casing 17 by welding at both the inlet and outlet ends as indicated at 33. Any excess length of tube 11 or 23 may be cut off if desired. While a length of the tubing 11 and 23 may extend beyond the muffler to permit clamping the muffler to the pipes connected to its inlet and outlet, the preferred procedure is for the finished muffler 31 to be installed by welding to the pipes leading to its inlet and outlet. As previously described, the muffler is readily constructed for the tailpipe and inlet pipe to fit into tubes 11 and 23 so that when welded in place a very firm and durable installation results.

There are numerous departures which may be made in the muffler construction as compared with the specific form illustrated and described. Whereas the casing is illustrated as 4 inches in diameter and the inlet and outlet tubes as 2 inches in diameter, the casing may alternatively be 5 inches, 3½ inches, 3 inches; and the inlet and outlet tubing may be 2½ inches, 2¼ inches, 1¾ inches, 1½ inches or intermediate dimensions. The inlet and outlet tubing need not be of the same diameter, although this is the simpler and preferred form which is illustrated. The inlet tube, as previously mentioned, may be perforated or not.

The tubing for the outlet tubes and the casing is most readily utilized in circular cross-section form as illustrated. However, tubing of oval cross-section may be utilized for the inlet tubing, the outlet tubing or for the casing. The length of the overlap of the inlet and outlet tubes is, of course, subject to wide variation in addition to which the interior openings of the inlet and outlet tubes may be closed in whole or in part rather than left entirely open as in the illustrated embodiment.

In addition to the variations and modifications of the invention which are described or suggested hereinabove, numerous other variations and modifications will be apparent to those skilled in the art. Accordingly, the scope of the invention is not limited to the specific embodiments shown or suggested, but is rather to be determined by reference to the appended claims.

What is claimed is:

1. Muffler apparatus comprising a rigid casing of homogenous construction having an elongated cylindrical form with domed ends having respective openings therein, and two elongated cylindrical tubes secured within said casing, said tubes having bent offset ends overlapping for a portion of their length with their outer ends communicating with said openings in said casing, at least one of said tubes having perforations therein, whereby exhaust gases entering one of said openings passes into the annular space between said tubes and said casing, and thence into the other one of said tubes and out of the other of said openings.

2. Apparatus as claimed in claim 1 wherein said tubes are deformed to a D-shaped cross-section and offset by about half their lateral dimension along their overlapping portions and welded together with their outer ends in approximately coaxial alignment.

3. Muffler apparatus comprising a rigid casing of homogeneous construction having an elongated form with convergent ends having respective openings therein, and two elongated tubes secured within said casing, said tubes overlapping for a portion of their length and together extending the length of said casing with their respective remote ends communicating with said openings in said casing, at least one of said tubes having perforations therein, said tubes being deformed and offset by about half their undeformed lateral dimension along their overlapping portions and welded together with their outer ends in approximately coaxial alignment.

4. Apparatus as claimed in claim 3 wherein said casing is of cylindrical form.

5. Apparatus as claimed in claim 4 wherein the convergent ends of said casing are substantially hemispherical.

6. Apparatus as claimed in claim 3 wherein said tubes are cylindrical and at least one of said tubes has perforations therein.

7. Apparatus as claimed in claim 3 wherein each of said tubes has a transverse dimension of about half that of said casing.

8. Apparatus as claimed in claim 6 wherein said perforations are louvered perforations.

9. Apparatus as claimed in claim 3 wherein said tubes are deformed to a D-shaped cross-section along their overlapping portions.

10. Muffler apparatus comprising a rigid casing of homogenous construction having an elongated cylindrical form with substantially hemispherical ends having respective openings therein, and two elongated cylindrical tubes secured within said casing each with a transverse dimension about half that of said casing, said tubes overlapping for a portion of their length and together extending the length of said casing with their respective remote ends communicating with said openings in said casing, at least one of said tubes having louvered perforations therein which open into said tube in a direction opposite to the tube end communicating with said casing opening, said tubes being deformed to a D-shaped cross-section and offset by about half their lateral dimension along their overlapping portions and secured together with their outer ends in approximately coaxial alignment, whereby exhaust gases entering one of said openings passes into the annular space between said tubes and said casing, and thence into the other one of said tubes and out of the other of said openings.

11. The method of making muffler apparatus comprising the steps of cutting 2 lengths of tubing about half the transverse dimension of the desired muffler transverse dimension to at least about one-half the desired muffler length, deforming at least one of said tubes to have an offset at one end thereof, welding said tubes together with an overlap so that the total length of said tubes is approximately that of the desired muffler length with the outer ends approximately coaxial, placing the tubes within a cylindrical casing having a transverse dimension equal to the desired muffler transverse dimension and a length slightly greater than the desired muffler length, and cold forming the ends of said tubing to a domed configuration with openings accomodating the respective ends of said tubes.

* * * * *